US006571697B2

(12) United States Patent
Eppinger

(10) Patent No.: US 6,571,697 B2
(45) Date of Patent: Jun. 3, 2003

(54) GARMENT LOADER

(75) Inventor: Otto Richard Eppinger, Braeside (AU)

(73) Assignee: Reefdale Proprietary Ltd., Braeside (AU)

( * ) Notice: Subject to any disclaimer, the term of this patent is extended or adjusted under 35 U.S.C. 154(b) by 188 days.

(21) Appl. No.: 09/825,928

(22) Filed: Apr. 5, 2001

(65) Prior Publication Data

US 2001/0029657 A1 Oct. 18, 2001

(30) Foreign Application Priority Data

Apr. 17, 2000 (AU) ..... PQ6929

(51) Int. Cl.[7] ..... B41L 13/00
(52) U.S. Cl. ..... 101/126; 101/35; 198/468.2
(58) Field of Search ..... 29/283, 448, 822; 101/35, 126; 198/468.2

(56) References Cited

U.S. PATENT DOCUMENTS 4,875,268 A * 10/1989 Szarka ..... 29/283
5,937,749 A * 8/1999 Ford ..... 101/126

FOREIGN PATENT DOCUMENTS

EP 0 109 598 A2 * 5/1984

* cited by examiner

*Primary Examiner*—P. W. Echols
(74) *Attorney, Agent, or Firm*—Connolly Bove Lodge & Hutz LLP

(57) ABSTRACT

A garment loader for a screen printing machine includes a carriage 37 which reciprocates between an extended position where a garment is fed into the jaws of grippers 42 attached to the carriage 37. The grippers are raised above the pallet 22 and the carriage retracts to the other end of the pallet 22 where the grippers 42 are lowered and release the garment which is now fitted on the pallet. While the pallet is rotated to the first print station the carriage is extended and the grippers lowered to be ready for loading the next garment.

2 Claims, 4 Drawing Sheets

GARMENT LOADER

FIELD OF INVENTION

This invention relates to improvements in screen printing machines and in particular to a device for loading garments onto pallets in automated screen printing machines.

BACKGROUND TO THE INVENTION

Screen printed garments are usually printed on rotary or oval multi print head machines in which the garments mounted on pallets are moved about the periphery of the machine where there are a series of print heads, curing stations and a load and an unload station. Patents relating to these machines include U.S. Pat. Nos. 4,407,195, 4,934,263, 5,154,119. Machines vary in size up to 20 stations which means there are up to 18 printing or curing heads plus the load and unload station. The operator sets up each print station with the appropriate screen, color and print settings before the garments are loaded. Usually the garments are printed in all the colors required and cured in one revolution of the machine. The garments are manually loaded at a fixed load station. The operator must lift the garment and place it onto the pallet surface ensuring that the garment is correctly oriented for the design to be printed correctly. The surface of the pallet is usually treated to be tacky so that the garment is adhered to the pallet and won't move during printing. In order to correctly position the garment the operator must bend and stretch across the pallet. The speed of the machine in printing a garment is the time that the operator has to load a garment because after printing is complete the machine indexes and rotates so that all pallets move to the subsequent print head and a new pallet arrives at the load station. Consequently the operator has to bend stretch and attach the garment to the pallet repetitively with little time to rest. This places strain on the operators back, lower back and shoulders.

A means for removing printed garments from pallets has previously been proposed in which a pair of grippers grasped the garment while it was on the pallet and pulled it off the pallet surface. The pallet was notched to accommodate the movement of the grippers in grasping the garment.

Garment handling devices are known from the garment manufacturing industry. U.S. Pat. No. 5,190,275 discloses apparatus for picking up and placing sleeves as part of a garment assembly operation. The apparatus includes a means for sensing the edge of a sleeve stack, gripping means comprising two aligned pickup fingers for grasping a sleeve and means to align the sleeve for sewing U.S. Pat. No. 4,727,979 discloses a hanger for use with a garment conveyor in a garment making plant. The grippers hold the garment vertically.

It is an object of this invention to provide means which can place a garment on the pallet of a screen printing machine.

BRIEF DESCRIPTION OF THE INVENTION

To this end the present invention provides a method of loading a garment onto a screen printing pallet which includes the steps of a) gripping a leading edge of the garment
b) pulling the garment over said pallet and
c) releasing the garment.

This method has the advantage of eliminating the need for the operator to bend and stretch to reach the far edge of the pallet. Preferably the operator takes the leading edge of the garment surface to be printed and feeds this leading edge into a set of grippers. The grippers hold the leading edge at one or more positions preferably at two positions adjacent each longitudinal edge of the pallet. The grippers are mounted on a reciprocating carriage adapted to move from a forward edge of the pallet adjacent the operator to the opposite end of the pallet. The carriage is mounted above the load station and the reciprocation can be performed by any suitable rectilinear actuator that moves the grippers from one end of the pallet to the other and back again.

In another aspect this invention provides a method of loading a garment onto a screen printing pallet which includes the steps of a) gripping a leading edge of the garment
b) lifting the edge above said pallet so that the garment optionally encloses one end of said pallet
c) pulling the garment over said pallet
d) lowering the leading edge so that the garment has a surface supported by said pallet and
e) releasing the garment.

The carriage preferably includes means to raise and lower the grippers. The grippers are initially open and may be closed when a sensor senses that the garment edge is able to be grasped by the grippers or by actuation of a switch by the operator. Once the grippers are closed on the garment, the loading operation commences. The grippers are raised above the plane of the pallet and the carriage then moves to be adjacent the other end of the pallet where the grippers are lowered and released. The reason for raising the garment above the pallet is to ensure that the rest of the garment lies below the pallet and that the surface of the garment is clear of the pallet surface until it is placed in contact with it. The garment needs to be smoothly laid on the pallet to aid printing. Usually the pallet surface is tacky to hold the garment securely during printing. After releasing the garment the grippers are then raised and the carriage returns to the front of the pallet and lowers the open grippers in readiness for the next garment.

In another aspect of this invention there is provided a garment loader adapted to be mounted over the pallet at a load station of a rotary screen printing machine said loader including a) a frame adapted for location adjacent to the loading station of the screen printing machine
b) a carriage mounted on said frame
c) said carriage adapted for reciprocal movement between a position adjacent the forward edge of the pallet to a position on the opposite side of said pallet
d) at least one gripper mounted on said carriage for grasping an edge of a garment to be loaded on said pallet.

Preferably the frame is mounted on the screen printing machine but may be provided as a free standing frame which can be moved into position adjacent the loading station. A track or rail is preferably provided on said frame to extend above the pallet parallel to the axis of the pallet support arm. The carriage reciprocates on the rail from the radially outer edge of the pallet toward the radially inner edge of the pallet.

Preferably said carriage also includes means for moving said gripper vertically toward and away from the plane of the pallet.

The means for actuating the carriage and the vertical movement of the grippers may be electric motors using a timing belt or hydraulic or pneumatic actuators. An advantage of the present invention is that the pallet needs no modification when the pallet loader is fitted.

BRIEF DESCRIPTION OF THE FIGURES

A preferred embodiment of the invention will be described with reference to the drawings in which.

DETAILED DESCRIPTION OF THE INVENTION

Figure 1:
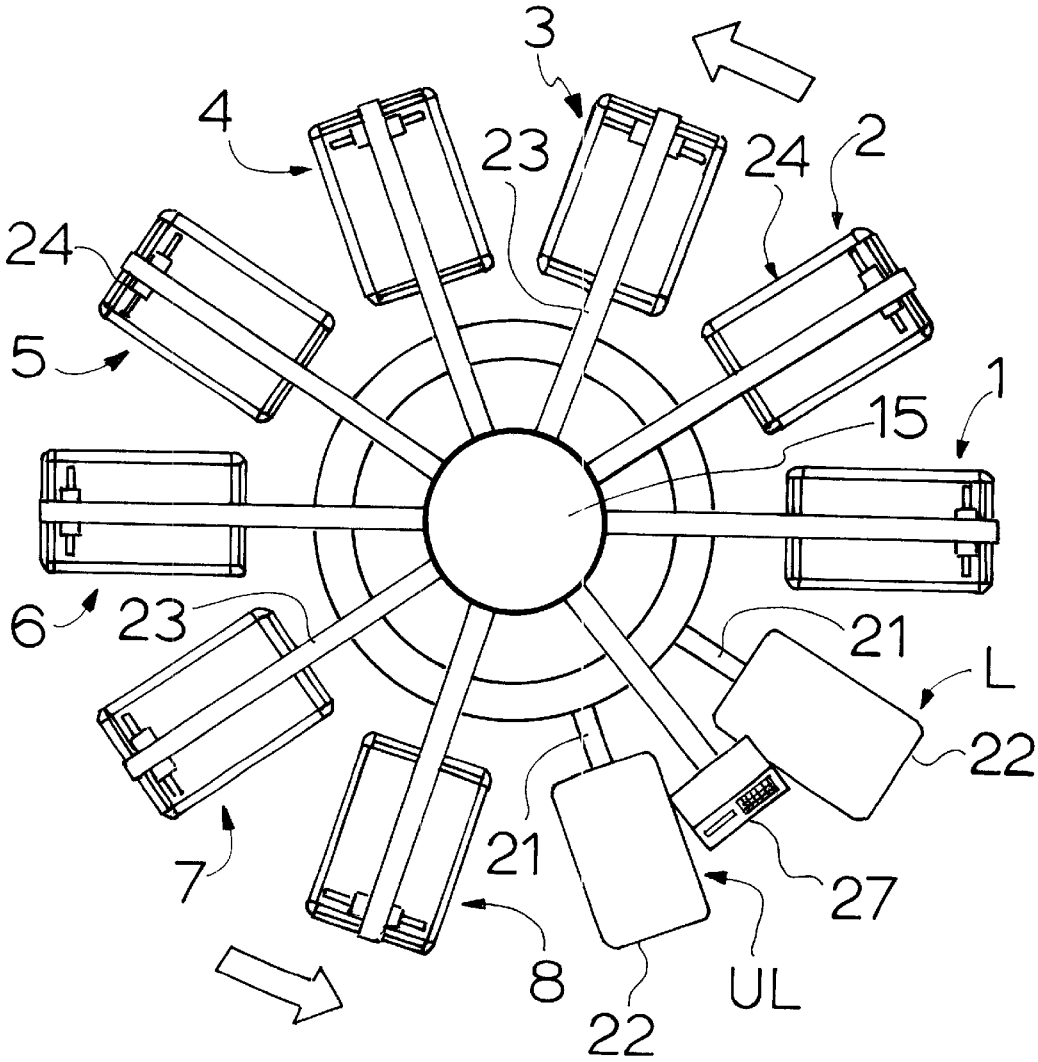
FIG. 1 is a schematic plan view of a rotary screen printing machine to which the garment loader of this invention is fitted.

In the machine illustrated the pallets rotate in an anti-clockwise fashion but it is equally possible for the machine to function with clockwise rotation of the pallets. The screen printing machine comprises a rotatable set of ten pallet arms 21 which are mounted for rotation about a central column 15. Each pallet arm 21 carries a garment pallet 22. Garments are fitted onto the pallets at the load station L and after printing is completed they are removed at the unload station UL. The pallet sizes are selected to correspond to the size of the garment. The garments are usually slid onto the pallets so that the garment forms a tube over the pallet and the surface that lies on the pallet is stretched to tautness for printing. Above the pallets are a set of eight printheads 24 mounted on fixed printhead support arms 23 which also radiate from the central column 15. The print heads are numbered from 1 to 8 and the load station L and the unload station UL are located between printheads 1 and 8. The pallet arms 21 rotate in an anticlockwise direction as shown by the arrow. Each rotation is indexed so that each pallet moves sequentially from one station to the next. Each contains controls [not shown] relating to the operation of the printhead such as on/off, print length, flood and squeegee pressure and speed, the number of print strokes and flash cure controls. As is conventional, the print heads can be substituted by flash cure units.

Between the load station L and the unload station UL where the operator stands, is a central control panel 27 as illustrated in FIG. 1.

This type of Screen printing machine can be of any conventional design and the number of print heads or cure stations can vary.

Figure 2:
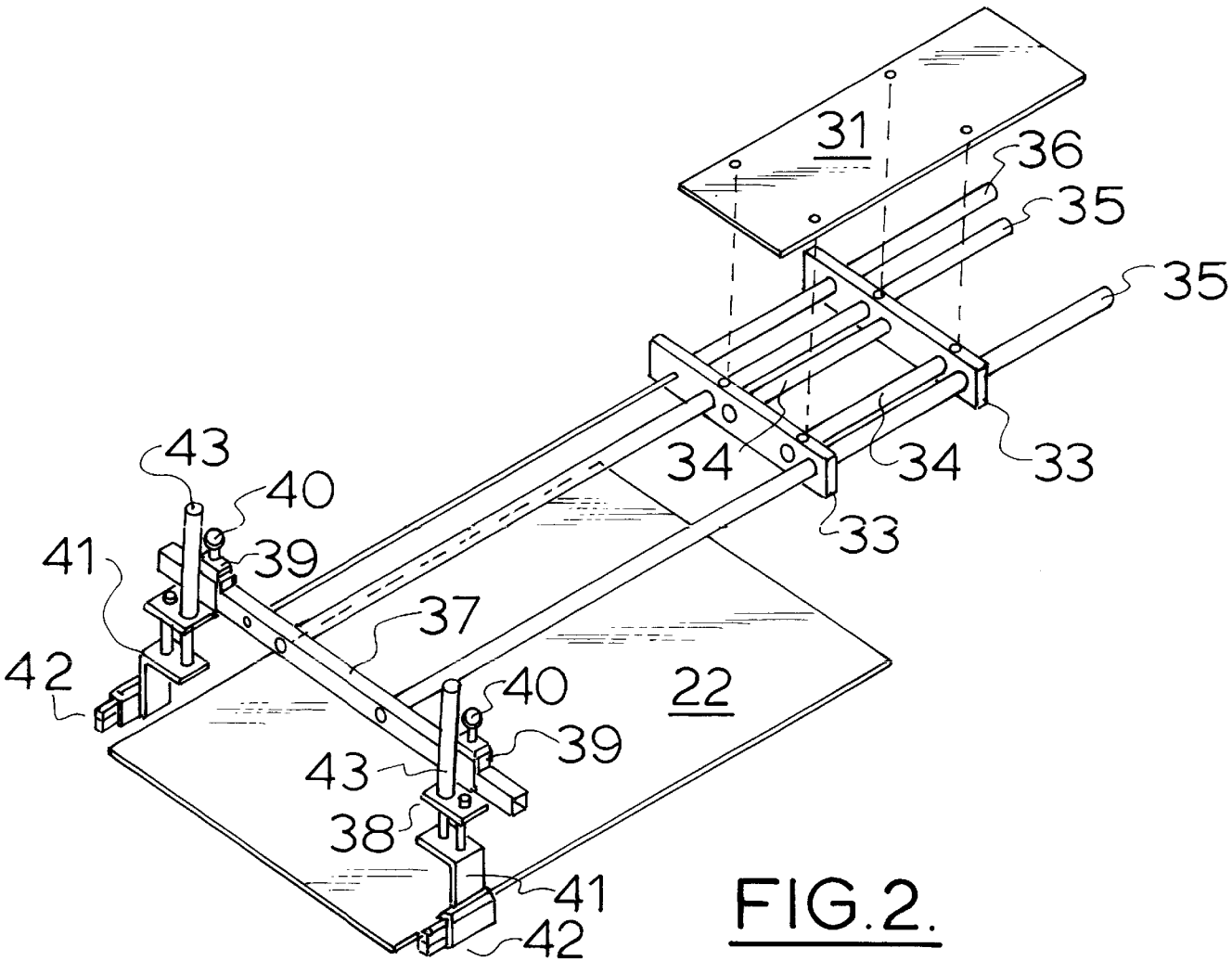
FIG. 2 is a perspective view of the loader shown above a pallet at the beginning of its motion.
Figure 3:
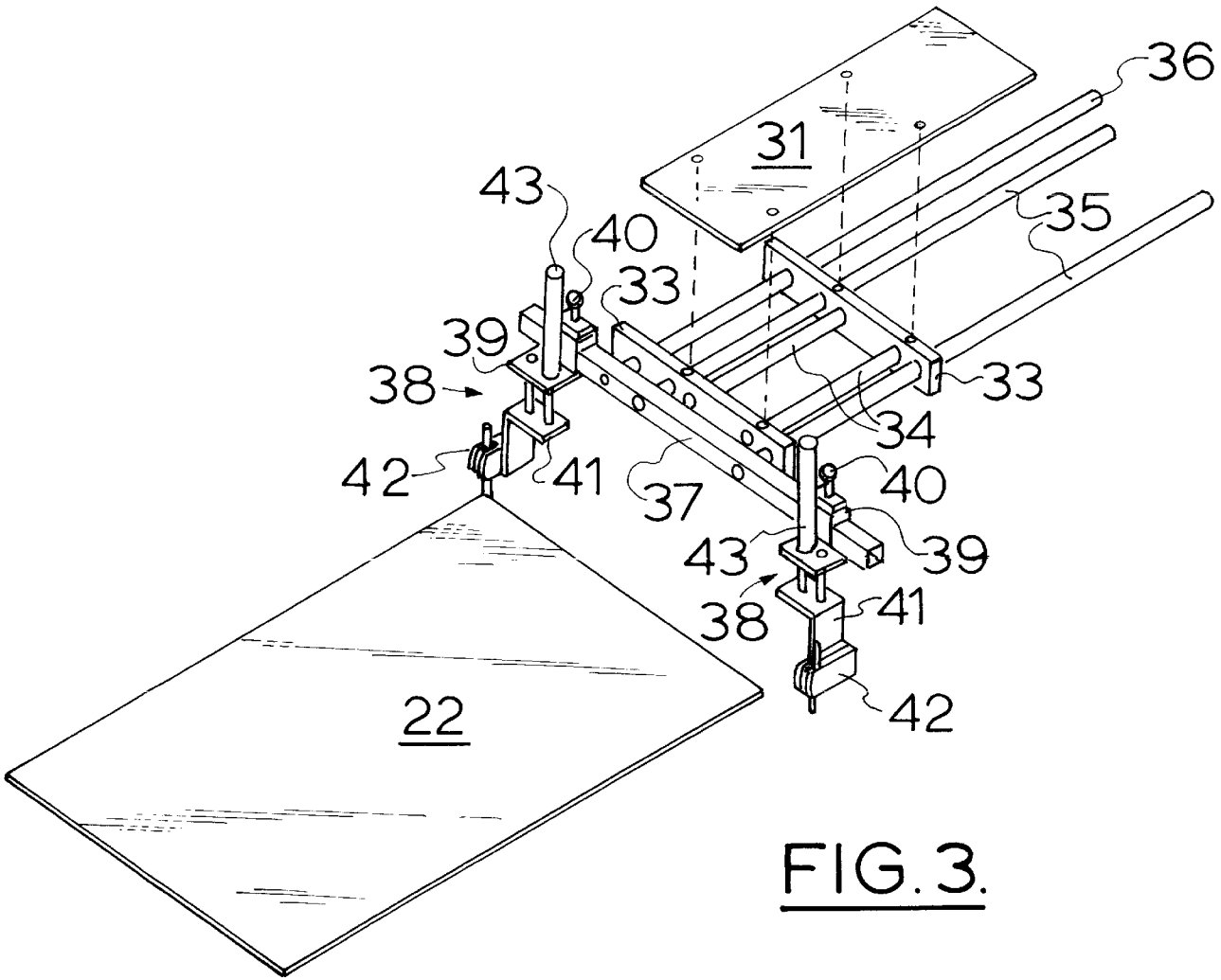
FIG. 3 is a perspective view of the garment loader in its retracted position.

The garment loader of this invention, schematically shown in FIGS. 2 and 3, is positioned above the pallet 22 at the load station L.

The loader is secured to the frame of the screen printing machine via plate 31 secured at four points to the support frame. This frame has two cross members 33 and two connecting rods 34, the carriage 37 is connected to two guide rods 35 which are slidable in bearings in the cross members 33. A telescoping actuator rod 36 moves the carriage 37 out to an extending position as shown in FIG. 2 or back to a retracted position s shown in FIG. 3. The distance traversed between the extended and retracted position is adjustable by using limit switches, adjustable stops mounted on the guide rods or by programming the actuator to move a predetermined distance. The distance selected corresponds to the radical length of the pallet.

Mounted on carriage 37 are two gripper assemblies 38. The gripper assemblies 38 include a bracket 39 slidable on the carriage 37 and able to be fixed in position by the adjustable knob fastener 40. This enables the distance between the gripper assemblies 38 to be adjusted to correspond to the width of the pallet 22 which in turn corresponds to the width of the garment to be printed. Attached to the bracket 39 is the gripper bracket 41 which holds the gripper jaws 42. The gripper jaws are shown open in FIG. 3 and closed in FIG. 2. The height of the gripper jaws 42 relative to the pallet 22 is adjusted by the vertical actuator rod 43 which raises or lowers gripper bracket 41 relative to the slidable bracket 39.

The operation of the loader as shown in FIGS. 2 and 3 relative to the screen printer is as follows:

a) The operator feeds the leading edge of the garment into the grippers 42 and then triggers a foot switch (not shown) to close the jaws on the leading edge of the garment. The lower edge of the garment will be below the pallet 22. The carriage 37 is in the extended position as shown in FIG. 2.

b) After the jaws close the loader operates automatically and the actuator 43 raises the pair of gripper brackets 41 so that the gripped edge of the garment is above the pallet. The raising of the grippers is preferred but not essential if the initial position of the grippers is above the pallet surface. The upward movement is preferred because it imparts a billowing effect to the garment.

c) The actuator 36 now operates to retract the carriage37 toward the far end of pallet 22 which is on the inner side of the machine. As the carriage 37 is retracted the garment is pulled over said pallet until the garment is fully loaded and the carriage is in its fully retracted position as shown in FIG. 3.

d) When the carriage is fully retracted the actuator 43 lowers the pair of gripper brackets 41 so that the garment contacts the pallet 22 and has a surface supported by pallet 22. The surface of the pallet is tacky with adhesive so that the garment surface doesn't move during printing.

e) Once the garment is set in position on the pallet the gripper jaws 42 release is the garment. The movements b c and d described above are carried out smoothly so that the upper portion of the garment billows out above the pallet surface and settles smoothly and tautly onto the tacky pallet surface.

f) After releasing the garment the gripper bracket 41 is raised by the actuator 43 to clear the pallet 22. At this point the Screening machine is ready to commence an indexation, rotating so that the pallet 22 moves from the load station L to the print station 1. During the rotation, the carriage 37 is moved by actuator 36 back to its fully extended position as shown in FIG. 2 and the actuator 43 then lowers the gripper brackets 41 so that the loader is now ready to receive another garment.

The time for carrying out the steps a) to e) is the same time allocated to the printing of the garments at each print head. The time taken to rotate the pallets is also sufficient to complete the movements described in step f).

The Gripper jaws may be actuated by a sensor or by an electric switch actuated by the foot pedal or by the central controller of the screen printer machine. The jaw design is not critical as long as the grip is strong enough to enable the garment to be pulled on to the pallet. The gripper brackets are usually spaced the width of the pallet apart. The operator stretches the garment when placing the leading edge in the gripper jaws so that the garment will lie tautly on the pallet.

Figure 4:
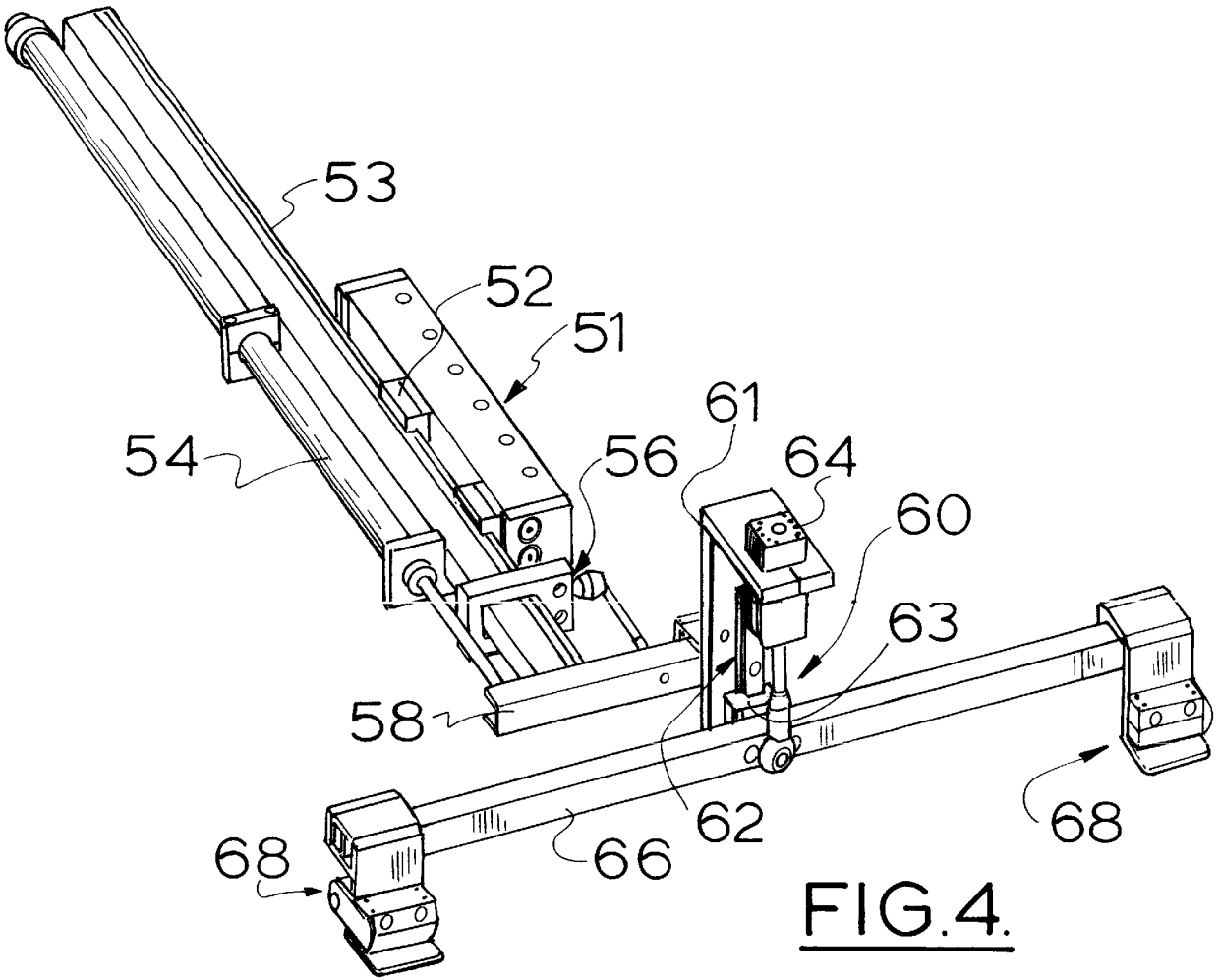
FIG. 4 is a perspective view of a further embodiment of the loader arm of this invention.

FIG. 4 illustrates another embodiment of the loader arm of this invention. The mounting block 51 is adapted for attachment to the printing machine at the load station. Preferably there are 6 mounting positions.

Attached to the mounting block 51 are rail guides 52 and the rail 53 is adapted to reciprocate in those guides. At the pallet end of the rail 53 is attached the mounting bar 58 to which the pneumatic actuator 54 is also attached to move the rail 53 back and forth. The fully retracted position of the actuator 54 corresponds to the rear edge of the pallet. The leading edge of the pallet will vary according to the size of the pallet and the extended position of the actuator is controlled by locating the adjustable stop clamp 56 at a location that ensures that the grippers are located in front of the leading edge of the pallet.

Secured to the mounting bar 58 is the gripper carriage 60 consisting of the vertical support frame 61 which supports the pneumatic actuator 64 and the rail 62. The actuator 64 is connected to the horizontal support arm 66 which is mounted on the rail guide 63 so that the bar 66 can reciprocate vertically driven by the actuator 64. Spaced apart on the support bar 66 are a pair of grippers 68. The position of the grippers on the bar 66 may be adjustable.

From the above it can be seen that this invention provides a safer alternative to manual loading of garments for screen printing machines.

What is claimed is:

1. A garment loader adapted to be mounted over the pallet at a load station of a rotary screen printing machine said loader including a) a frame adapted for location adjacent to the loading station of the screen printing machine b) a carriage mounted on said frame c) said carriage adapted for reciprocal movement between a position adjacent the forward edge of the pallet to a position on the opposite side of said pallet d) at least one gripper mounted on said carriage for grasping an edge of a garment to be loaded on said pallet.

2. A garment loader as claimed in claim 1 which also includes means to move the at least one gripper vertically relative to said pallet.

* * * * *